US012025317B2

(12) United States Patent
Holtdirk

(10) Patent No.: US 12,025,317 B2
(45) Date of Patent: Jul. 2, 2024

(54) METHOD FOR RELEASABLY CONNECTING A FITTED DEVICE TO A PIECE OF FURNITURE AND SYSTEM FOR CARRYING OUT THE METHOD

(71) Applicant: Miele & Cie. KG, Gütersloh (DE)

(72) Inventor: Hans-Gerd Holtdirk, Lippstadt (DE)

(73) Assignee: MIELE & CIE. KG, Gütersloh (DE)

( * ) Notice: Subject to any disclaimer, the term of this patent is extended or adjusted under 35 U.S.C. 154(b) by 294 days.

(21) Appl. No.: 17/377,470

(22) Filed: Jul. 16, 2021

(65) Prior Publication Data

US 2022/0026076 A1 Jan. 27, 2022

(30) Foreign Application Priority Data

Jul. 27, 2020 (DE) ..... 10 2020 119 747.0

(51) Int. Cl.
*F24C 15/30* (2006.01)

(52) U.S. Cl.
CPC ..... *F24C 15/30* (2013.01)

(58) Field of Classification Search
None
See application file for complete search history.

(56) References Cited

U.S. PATENT DOCUMENTS 3,208,135 A * 9/1965 Newbold ..... F16B 12/24 411/389
3,784,273 A * 1/1974 Nikolai ..... A47B 47/0075 16/382
2012/0286632 A1* 11/2012 Wilson ..... F25D 23/10 312/204
2023/0135463 A1* 5/2023 Leet ..... A47B 13/003 403/264

FOREIGN PATENT DOCUMENTS

| | | | | |
|---|---|---|---|---|
| CH | 687099 A5 * | 9/1996 | ..... | F16B 37/14 |
| DE | 7635775 U1 | 8/1977 | | |
| DE | 2836056 A1 * | 2/1980 | | |
| DE | 2922384 A1 * | 4/1980 | | |
| DE | 102005057141 A1 | 6/2007 | | |
| DE | 102011002148 A1 * | 10/2012 | ..... | E05D 3/16 |
| DE | 102018128355 A1 | 5/2020 | | |
| DE | 202020105956 U1 * | 12/2020 | ..... | F16B 12/14 |
| FR | 2326839 A * | 6/1977 | ..... | A47B 77/08 |
| FR | 2370883 A1 * | 6/1978 | | |

* cited by examiner

*Primary Examiner* — Steven M Marsh
(74) *Attorney, Agent, or Firm* — Dickinson Wright PLLC

(57) ABSTRACT

A method for releasably connecting a fitted device (200) to a piece of furniture (320) uses a connecting device (110). The fitted device (200) includes an attachment element (220) disposed on its housing (5), and the connecting device (110) includes an at least two-part connecting element (14) and a mounting gauge (130). The method involves inserting the fitted device (200) into an installation recess (310) adjacent to the piece of furniture; aligning the fitted device (200) relative to the piece of furniture (320); positioning the mounting gauge (130) on the attachment element (220); connecting, guided by the mounting gauge (130), a first part (122) of the connecting element (14) to the piece of furniture; removing the mounting gauge (130); and fixing the fitted device (200) on the piece of furniture (320) by connecting a second part (125) of the connecting element (14) to the first part.

11 Claims, 2 Drawing Sheets

METHOD FOR RELEASABLY CONNECTING A FITTED DEVICE TO A PIECE OF FURNITURE AND SYSTEM FOR CARRYING OUT THE METHOD

TECHNICAL FIELD

The invention relates to a method for releasably connecting a fitted device to a piece of furniture of a furniture environment using a connecting device, the piece of furniture being adjacent to an installation recess for the fitted device, wherein the fitted device includes an attachment element disposed on its housing. The invention also relates to a system for carrying out such a method.

BACKGROUND

Such systems and methods for releasably connecting a fitted device to a piece of furniture of a furniture environment via a connecting device, wherein the piece of furniture is adjacent to an installation recess for the fitted device, are already known from the prior art in a variety of mutually different embodiments. Here in most cases the fitted device is inserted into the installation recess and aligned, and then a wood screw is guided through an opening on the device or through the attachment element provided on the device, and screwed into the piece of furniture. Such a connection has the disadvantage that the device is moved from its aligned position by non-centric placement the screw in the opening and by subsequently screwing the screw in. A further disadvantage consists in that the release of the connection between the device and the piece of furniture is difficult, and if possible at all is only possible with the aid of a tool. A renewed attachment is also sometimes no longer possible if the screw hole in the piece of furniture breaks out.

SUMMARY

It is an objective of the invention to improve a method for releasably connecting of a fitted device to a piece of furniture.

This objective is met by a method comprising the following method steps: inserting the fitted device having an attachment element into the installation recess and aligning the fitted device with its attachment element with respect to the piece of furniture; positioning a mounting gauge on the attachment element; connecting, guided by the mounting gauge, a first part of a connecting element to the piece of furniture; removing the mounting gauge; and fixing the fitted device on the piece of furniture by connecting a second part of the connecting element to the first part.

Furthermore, a system suitable for performing the method is presented with additional refinements.

The advantage achievable with the invention consists in particular in improving a method for releasably connecting of a fitted device to a piece of furniture, and in presenting a system for carrying out such a method. Due to one aspect of the method and of the system, it is possible, for example, to remove, without a tool, the fitted device from an installation position of the fitted device in the installation recess of the furniture environment. Accordingly, the fitted device is also removable from the installation recess of the furniture environment without a special tool and without special technical knowledge, for example, by a user of the fitted device. Due to the invention, it is furthermore possible to connect the fitted device to a power supply in a standard manner, for example, using a conventional power plug. The invention is advantageous in particular with provisional installation of fitted devices, such as household appliances, in furniture environments, such as occurs, for example, at trade fairs, in exhibition spaces of appliance and furniture manufacturers, or in sales areas of appliance and furniture dealers. In addition, the use of a mounting gauge during the installation of the fitted device into the installation recess, namely during the attachment of the fitted device to the piece of furniture of the furniture environment, ensures a proper alignment and attachment of the fitted device in the installation recess.

In principle, the method or the system are freely selectable within broadly suitable limits depending on the type, functionality, dimensioning, material, and assembly. For example, the fitted device of the inventive system may be a cooking device, such as an oven, a microwave device, a steamer, as a combination device formed from the above-mentioned functions, as a dishwasher, or as a beverage dispenser.

One advantageous further development of the inventive system provides that the attachment element is configured as a front frame formed or installed on the housing. In this way the attachment element of the system is constructively configured in a particularly suitable manner.

One advantageous refinement of the above-mentioned embodiment of the inventive system provides that the first part is configured as a stud, wherein the stud includes a nail extension or a screw extension for connecting to the piece of furniture, and/or, that the second part includes a collar, preferably a collar including a handle, disposed or formed on the collar, that is configured such that in the connected state of the system the connecting element fixes the attachment element on the piece of furniture. In this way the connecting element is particularly suitably and robustly formed, constructively and in terms of the installation. The preferred design of this further development also facilitates a tool-free handling of the system.

One advantageous further development of one of the two last-mentioned embodiments of the inventive system provides that the first part and the second part include mutually corresponding internal and external threads. In this way the first and the second part of the connecting element are connectable to each other in a simple and functionally reliable manner.

Another advantageous refinement of the inventive system provides that the attachment element includes a through-opening, and the mounting gauge is configured as a sleeve insertable into the through-opening, preferably a sleeve including a collar, particularly preferably a sleeve including a collar and a handle disposed or formed on the collar. In this way the attachment element and the mounting gauge are constructively coordinated in a particularly simple manner. The preferred and the particularly preferred design of this refinement furthermore facilitate a tool-free handling of the system. It is advantageous in particular if the maximum diameter of the first part is smaller than the diameter of the through-opening. Then the fitted device can be pulled out of the installation recess without the first part of the connecting element having to be removed from the piece of furniture.

It is also advantageous if the mounting gauge is adapted to the attachment element such that neither a clearance fit nor an interference fit results. A precise installation of the stud and a simple handling of the mounting gauge is thereby made possible.

One advantageous refinement of the above-mentioned embodiment of the inventive system provides that the mounting gauge is adapted to the attachment element such that in a state of the mounting gauge having been inserted into the through-opening, the mounting gauge extends essentially over an entire depth of the attachment element. In this way a reliable guidance of the connecting element is ensured in the first mounting step, and thus a proper aligning is ensured of the connecting element with the piece of furniture and with the fitted device including the attachment element while connecting the fitted device to the piece of furniture by the connecting element.

An exemplary embodiment of the invention is depicted purely schematically in the drawings and described in more detail below.

DETAILED DESCRIPTION OF THE DRAWINGS

In FIGS. 1 to 4, a non-limiting example of the inventive system 100 for carrying out the inventive method is provided.

Figure 1:
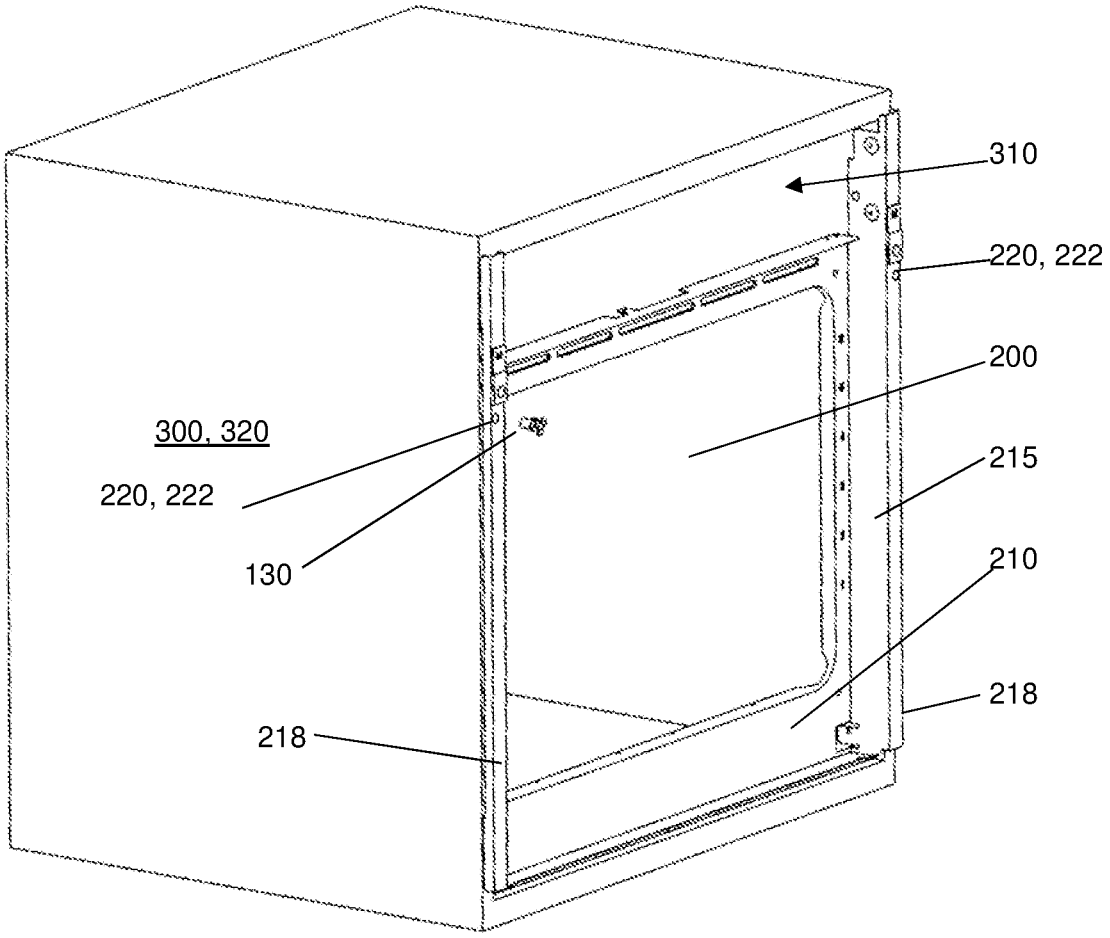
FIG. 1 shows a built-in oven in a furniture environment, therein the built-in oven forms a fitted device.

FIG. 1 shows a fitted device 200 on the example of a built-in oven, wherein parts not significant to the invention, such as the door or structures in the interior, are omitted for better clarity. The fitted device 200 is inserted with its housing 210, which forms the outer casing of the device 200, into the installation recess 310 of a furniture environment 300. In the exemplary embodiment shown, the furniture environment 300 and thus also the installation recess 310 are formed by a single furniture body that receives the fitted device 200. The connection of the fitted device 200 is therefore effected on a piece of furniture 320 that is provided by the furniture body itself. In a variant not depicted in the Figures, it is also possible that a reserved space is formed between multiple furniture bodies disposed against or near each other, in which reserved space the fitted device 200 can be inserted. In this case the reserved space then forms the installation recess 310 and at least one of the adjacent furniture bodies forms the furniture environment 300, wherein the fitted device 200 is then connected to a wall of at least one adjacent furniture body as piece of furniture 320.

It can also be seen in FIG. 1 that the fitted device 200 includes a front frame 215 that includes a beveled region 218 on both sides. These two regions 218 protrude beyond the inner dimension of the installation recess 310, and thereby together form a stop that delimits the insertion movement of the device into the recess 310. Both regions 218 are equipped with a through-opening 222, and thus each form an attachment element 220 that is part of the system 100 for releasably connecting the fitted device to the adjacent piece of furniture 320. After the inserting the device 200 into the installation recess 310, the device 200 can also be aligned such that it is placed centrally in the recess 310, and/or that the piece of furniture 320, to which the device 200 is to be connected, is disposed behind the attachment element 220, i.e., behind the through-opening 222.

After this is the case, in the next installation step (see FIG. 2) the inserting of a mounting gauge 130 into the through-opening 222 occurs. For this purpose the mounting gauge 130 is configured as a sleeve 132 and includes a collar 134 that serves as a stop. A handle 136 facilitates the pulling-out of the gauge 130. The sleeve 132 is adapted to the through-opening 222 such that neither a clearance fit nor an interference fit results, i.e., the sleeve 132 sits in the through-opening 222 without clearance. In addition, the mounting gauge 130, in a state inserted in the through-opening 222, extends over the entire depth of the attachment element 220. Guided by the mounting gauge 130, the first part 121 of a connecting element 120 is then connected to the piece of furniture 320. For this purpose the first part 121 is configured as a stud bolt 122 including a screw extension 123 on its tip. Instead of the screw extension 123, a nail extension (not depicted) can also be provided. In the exemplary embodiment shown, the rear part 124 of the stud 122 is provided with a Torx engagement; of course a slot or a cross-slot (both not depicted) can also be provided. In addition, the rear part 124 is configured thicker than the front screw extension 123. Here, however, the maximum diameter of the rear part 124 should not be greater than the diameter of the through-opening 222. It is only thereby ensured that the device can be pulled out of the installation recess 310 without screwing-out of the stud.

Figure 2:
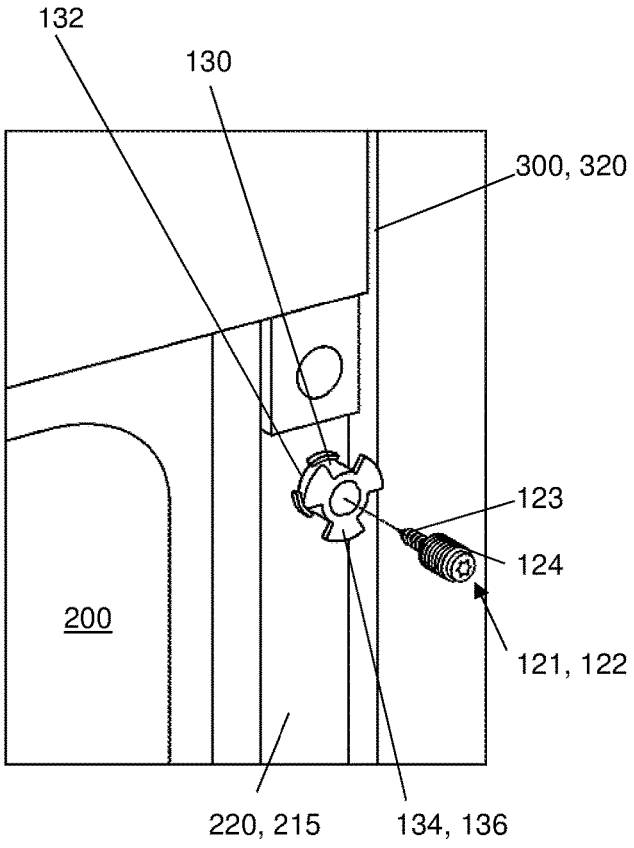
FIGS. 2, 3 and 4 show the installation sequence during the installation of the oven with reference to an enlarged section of FIG. 1.
Figure 3:
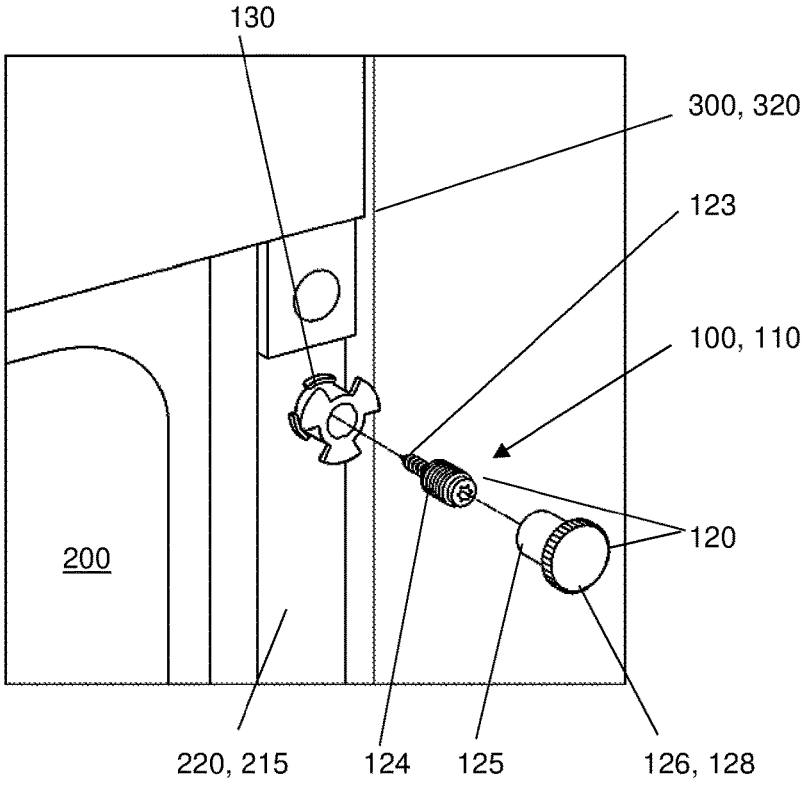

After the screwing-in of the stud 122, the mounting gauge 130 can be pulled out and removed. The stud 122 is now disposed centered in the through-opening 222. As can be seen in FIGS. 2 and 3, it is equipped on its rear part 124 with an external thread. A second part 125 of the connecting element 120 is now screwed onto this external thread; see FIG. 3. For this purpose this part 125 includes a sleeve 126 that is equipped with an internal thread. In order to make possible a manual screwing-on without tool use, a collar 127 including a handle 128 in the form of a knurling is formed on the sleeve 126. In addition, external threads of the first part 121 and internal threads of the second part are adapted to each other with respect to the fit such that a smooth screw connection can be produced. It is particularly advantageous if the outer diameter of the sleeve 126 is slightly smaller than the diameter of the through-opening 222, so that after the screwing-on of the second part onto the first part, the sleeve lies in the through-opening 222, and only the collar 127 is still visible, the diameter of which collar 127 is in turn greater than the diameter of the through-opening 222.

Figure 4:
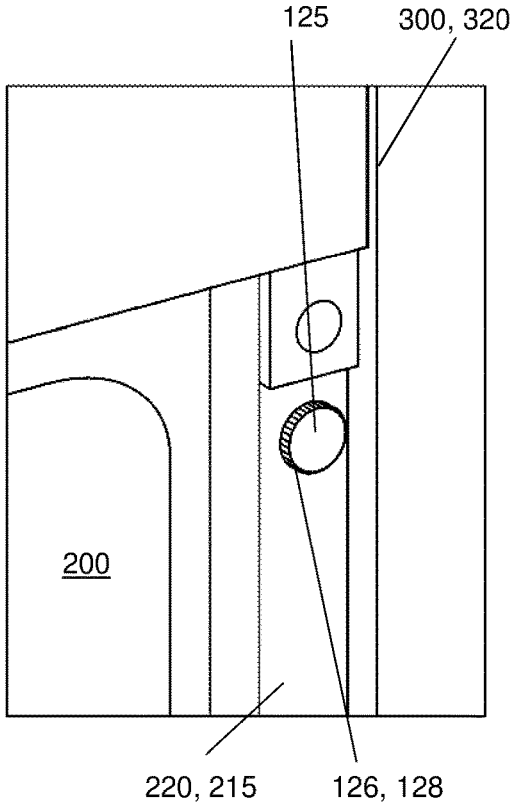

FIG. 4 shows the connecting element 120 with screwed-on second part 125. In this position the fitted device 200 is fixed with its attachment element 220 on the piece of furniture 320. Here the mounting gauge 130 and the connecting element together form a connecting device 110.

While the above description constitutes the preferred embodiments of the present invention, the invention is susceptible to modification, variation and change without departing from the proper scope and fair meaning of the accompanying claims.

100 System
110 Connecting device
120 Connecting element
121 First part of the connecting element
122 Stud
123 Screw extension
124 Rear part of the stud
125 Second part of the connecting element
126 Sleeve
127 Collar
128 Handle
130 Mounting gauge
132 Sleeve
134 Collar
136 Handle
200 Fitted device

210 Housing
215 Front frame
220 Attachment element
222 Through-opening
300 Furniture environment
310 Installation recess
320 Piece of furniture

What is claimed is:

1. A method for releasably connecting a fitted device (200) to a piece of furniture (320) of a furniture environment (300) via a connecting device (110), the piece of furniture (320) being adjacent to an installation recess (310) for the fitted device (200), wherein the fitted device (200) includes a housing (210) with an attachment element (220) disposed thereon, and wherein the connecting device (110) includes a mounting gauge (130) and a connecting element (120) consisting of at least two parts, the method comprising the following method steps:

inserting the fitted device (200) into the installation recess (310), and aligning the fitted device (200), including the attachment element (220), relative to the piece of furniture (320);

positioning the mounting gauge (130) on the attachment element (220);

connecting, guided by the mounting gauge (130), a first part (121) of the connecting element (120) to the piece of furniture (320);

removing the mounting gauge (130);

fixing the fitted device on the piece of furniture (320) by connecting a second part (125) of the connecting element (120) to the first part (121).

2. System for releasably connecting a fitted device (200) to a piece of furniture (320) of a furniture environment (300), wherein the piece of furniture is adjacent to an installation recess (310) for the fitted device (200), the system comprising:

an attachment element (220) disposed on the fitted device (200), and a connecting device (110) comprising a mounting gauge and a connecting element (120) with at least a first part and a second part, wherein the attachment element (220) and the connecting device (110) are configured for carrying out the following method steps:

inserting the fitted device (200) into the installation recess (310), and aligning the fitted device (200) including the attachment element (220) relative to the piece of furniture (320);

positioning the mounting gauge (130) on the attachment element (220);

connecting, guided by the mounting gauge (130), the first part (121) of the connecting element (120) to the piece of furniture (320);

removing the mounting gauge (130);

fixing the fitted device (200) on the piece of furniture (320) by connecting the second part (125) of the connecting element (120) to the first part (121).

3. System (100) according to claim 2, wherein the fitted device (200) includes a housing (210), and wherein the attachment element (220) is part of a front frame (215) formed or installed on the housing (210).

4. The system (100) according to claim 2, wherein the first part (121) is configured as a stud (122), wherein the stud (122) includes a nail extension or a screw extension (123) for connecting to the piece of furniture (320).

5. The system (100) according to claim 2, wherein the second part (125) includes a collar (127) configured for affixing the attachment element (220) to the piece of furniture (320) in a connected state of the system (100).

6. The system (100) according to claim 2, wherein the first part (121) and the second part (125) include mutually corresponding internal and external threads.

7. The system (100) according to claim 2, wherein the attachment element (220) includes a through-opening (222) and the mounting gauge (130) is configured as a sleeve (132) insertable in the through-opening (222).

8. The system (100) according to claim 7, wherein the mounting gauge is a sleeve (132) including a collar (134) and a handle (136) disposed or formed on the collar (134).

9. The system (100) according to claim 7, wherein the first part (121) has a maximum diameter that is smaller than a maximum diameter of the through-opening (222).

10. The system (100) according to claim 7, wherein the mounting gauge (130) is dimensioned for a close fit in the attachment element (220) such that neither a clearance fit nor an interference fit is present.

11. The system (100) according to claim 7, wherein the attachment element (220) has a depth and the mounting gauge, in an inserted state of the mounting gauge (130) in the through-opening (222), extends over the entire depth.

* * * * *